United States Patent [19]

Pircher et al.

[11] Patent Number: 4,994,118

[45] Date of Patent: Feb. 19, 1991

[54] PROCESS FOR THE PRODUCTION OF HOT ROLLED STEEL OR HEAVY PLATES

[75] Inventors: Hans Pircher, Mülheim; Rudolf Kawalla, Oberhausen; Jürgen Mahn, Krefeld; Gerd Sussek, Müheim; Walter Wilms, Duisburg; Waldemar Wolpert, Dinslaken, all of Fed. Rep. of Germany

[73] Assignee: Thyssen Stahl AG, Duisburg, Fed. Rep. of Germany

[21] Appl. No.: 386,550

[22] Filed: Jul. 27, 1989

[30] Foreign Application Priority Data

Jul. 28, 1988 [DE] Fed. Rep. of Germany ..... 3825634

[51] Int. Cl.[5] ..... C21D 8/04

[52] U.S. Cl. ..... 148/2; 148/12 E; 148/12 EA; 148/11 SN

[58] Field of Search ..... 148/2, 12 E, 12 EA, 148/11 SN

[56] References Cited

U.S. PATENT DOCUMENTS

| | | | |
|---|---|---|---|
| 4,256,516 | 3/1981 | Duchi et al. | 148/12 E |
| 4,514,236 | 4/1985 | Cook et al. | 148/12 E |

FOREIGN PATENT DOCUMENTS

| | | | |
|---|---|---|---|
| 62-56530 | 3/1987 | Japan | 148/12 E |
| 63-186822 | 8/1988 | Japan | 148/12 E |
| 2175825 | 12/1986 | United Kingdom | 148/11 SN |

*Primary Examiner*—Deborah Yee

*Attorney, Agent, or Firm*—Sprung Horn Kramer & Woods

[57] ABSTRACT

The invention relates to a process for the production of hot rolled strip or heavy plates from stainless and refractory steels or from forgeable alloys on a nickel basis with a final thickness in the range of 5 to 60 mm by the production of a slab from monobloc casting or by continuous casting and heating the slab at a temperature above 1100° C. followed by the hot rolling of the slab and accelerated cooling of the product rolled to the end thickness. The characterizing feature of the invention is that the heated slab is rolled without interruptions first to a maximum of 1/6 of its initial thickness, mainly by deformation passes in which the degree of deformation pass in the thickness direction is greater than the degrees of deformation shown by curve A in FIG. 1, in dependence on the surface temperature of the product. Then finish rolling is performed to the end thickness, mainly by deformation passes in which the degree of deformation per pass in the thickness direction is greater than the degrees of deformation shown by curve B1 or curve B2 in FIG. 1, in dependence on the surface temperature of the product and the pause between two adjacent passes as parameters. The surface temperature of the finish rolled product must be not less than 1030° C., if the product contains up to 1.0% molybdenum and not less than 1050° C., if the product contains more than 1.0% molybdenum.

At the latest 100 seconds following finish rolling, the product is cooled at an accelerated rate with a speed in the core of more than 3 K/sec, more particularly more than 5 K/sec, to a temperature which is equal to or lower than 650° C.

19 Claims, 1 Drawing Sheet

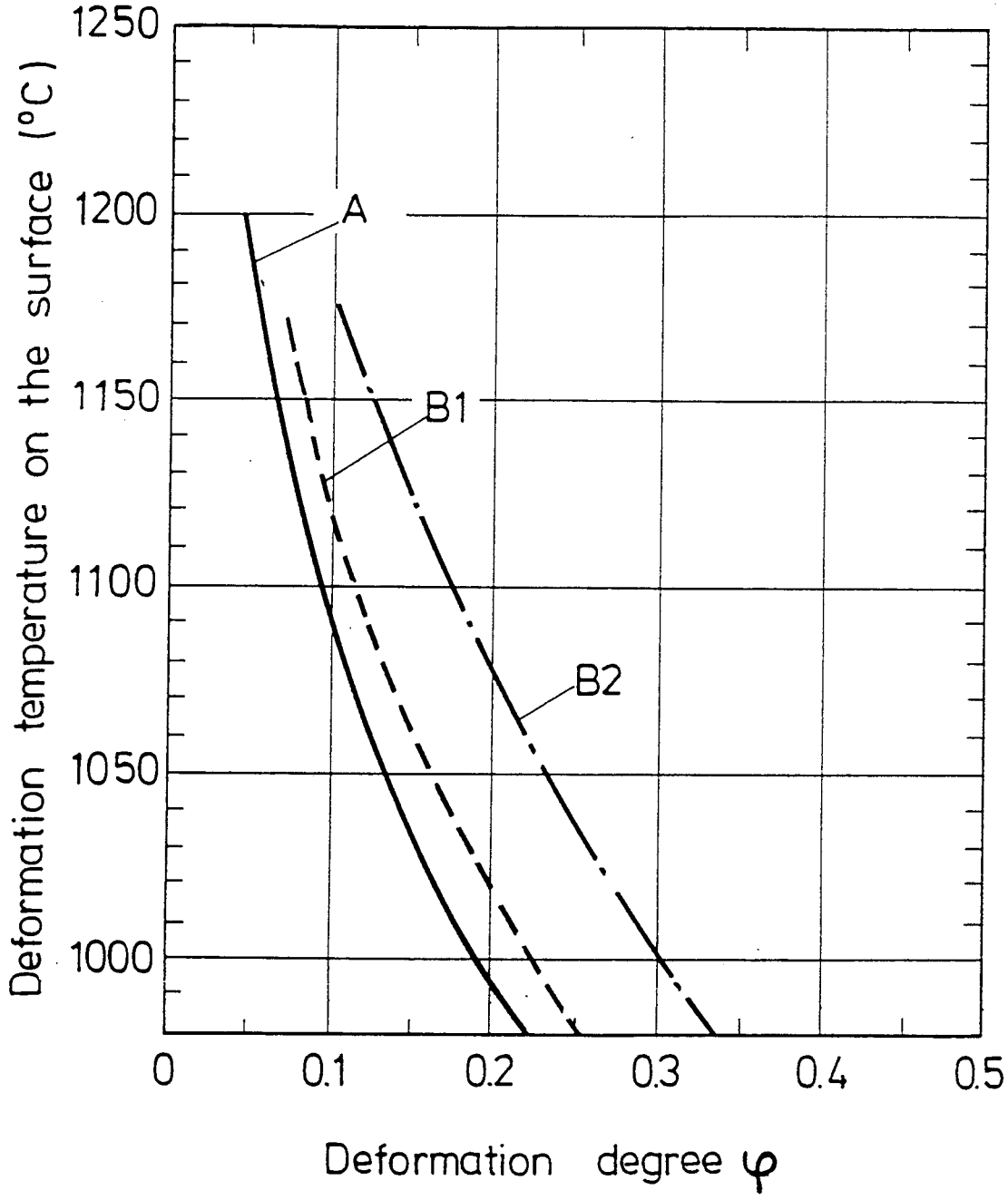
1250
1200
1150
1100
1050
1000
Deformation temperature on the surface (°C)
A
B1
B2
0
0.1
0.2
0.3
0.4
0.5
Deformation degree φ

PROCESS FOR THE PRODUCTION OF HOT ROLLED STEEL OR HEAVY PLATES

The invention relates to a process for the production of hot rolled strip or heavy plates from stainless and heat resistant steels or forgeable alloys on a nickel basis having an end thickness in the range of 5 to 60 mm by producing a slab from monobloc casting or by continuous casting and heating the slab at a temperature above 1100° C., followed by the hot rolling of the slab and accelerated cooling of the product rolled to the end thickness.

German OS No. 36 17 907 discloses a process as set forth in the preamble of claim 1 for the production of austenitic stainless steels having high corrosion resistance and high mechanical strength both at surrounding temperature and at elevated temperatures. This citation discloses concerning the prior art that the steel plates—i.e., heavy plates of stainless austenitic steels—of the composition stated in the citation must normally, after blooming and finish rolling, followed by cooling in air to room temperature, be subjected to a subsequent thermal treatment or solution annealing. This is performed so as to reduce the work hardening caused by deformation and redissolved precipitations of intermetallic or carbidic phases which have a negative effect on the corrosion resistance of the product. To this end the subsequent solution annealing must generally be performed at temperatures of more than 1000° C. and with correspondingly long holding times adequate to redissolve the precipitations. The work hardening caused by deformation is at the same time reduced by recovery and recrystallization. Consequently, in the solution-annealed condition, the stainless steel plates and heavy plates produced by this conventional process have as regards mechanical properties such as, for example, strength, toughness and corrosion resistance a spectrum of properties characteristic of low mechanical strength.

However, due to the reheating of the finish rolled product to more than 1000° C. and the required holding times, the solution annealing following blooming and finish rolling after cooling in air to room temperature, means high production costs and longer manufacturing times. Furthermore, as a rule the subsequent annealing process is connected with an additional scaling of the product, so that its surface quality may deteriorate.

As a rule this means further extra expense for the necessary final descaling of the finish rolled product.

Starting inter alia from these disadvantages, the object to which German OS No. 36 17 907 relates is to provide a process for the production of austenitic stainless steel plates which have improved corrosion strength and resistance to cracking both at surrounding temperatures and also at higher temperatures, without the need to use a following reheating furnace, as required in the conventional process for the subsequent solution annealing.

As the solution of this problem it is proposed first of all to heat to a temperature of more than 1000° C. the slab of an austenitic stainless steel grade which conventionally requires subsequent solution annealing and from which the steel plate is to be produced. Then the heated slab is hot rolled in the recrystallization range of austenite and preferably also in the non-recrystallization range, with a finish roll temperature of more than 800° C. It is indispensable to perform finish rolling in the non-recrystallization range, to achieve a higher mechanical strength. Immediately after finish rolling to end thickness, accelerated cooling is performed with a mean cooling speed of more than 2 K/sec to a temperature of at least 550° C. If these rolling and cooling conditions are observed, the conventional subsequent solution annealing is no longer necessary.

As the examples show, more particularly when compared with finish rolled steel plates of the same austenitic stainless steel grades and the same end thickness, but in the solution-annealed condition, the product obtained by this process has substantially improved mechanical strength and comparable corrosion resistance. A higher strength is more particularly achieved if the hot rolling is also performed in the non-recrystallization range. In detail the Examples show that in this prior art process with a product end thickness of 20 mm the heating and soaking temperature for the slab is preferably in the range of 1100° to 1200° C., the finish roll temperature has a value in the range of 900° to 970° C.—i.e., in any case lower than 1000° C.—and immediately after finish rolling with a temperature loss of only about 10° C. the accelerated cooling starts to a value of 500° C., preferably 300° C., and more particularly to room temperature. A finish rolling temperature of more than 1000° C. is obtained only with an end thickness of 40 mm, more particularly 100 mm, of the product or heavy plate.

If hot rolled strip or heavy plates are to be produced from stainless and heat resistant steels or from forgeable alloys on a nickel basis having the composition set forth in Table 1, but with a spectrum of properties corresponding to the spectrum of properties of the same product in the solution-annealed condition, this prior art process is unsuitable for the production of heavy plates, more particularly hot rolled strip, for the following reasons:

If heavy plates having an end thickness of less than 60 mm are bloomed and finish rolled by this process, the finish rolling temperature is reduced so heavily that it is impossible to adjust a spectrum of properties comparable, for example, as regards strength toughness and corrosion resistance with heavy plates in the solution-annealed condition. The process known from German OS No. 36 17 907 results basically in higher mechanical strength, but this is undesirable with regard to the processing and utility properties of the heavy plates, so that the finish-rolled plates must then be subjected to a subsequent solution annealing, if they have an end thickness of less than 60 mm, more particularly less than 40 mm.

The same thing also applies to the production of hot rolled strip which, due to the high temperature losses occurring more particularly during the finish rolling phase as a result of the small strip thickness, must be subjected to a solution annealing following finish rolling. Moreover, this thermal treatment, which is as a rule performed in a continuous furnace followed by a pickling line, limits the production of hot rolled strip to a maximum end thickness of about 10 mm, although it is basically possible also to perform the hot finish rolling of hot rolled strip having an end thickness of the order of magnitude of about 20 mm.

If therefore the hot rolled strip and the heavy plates are to have a spectrum of properties as in the solution-annealed condition, a thermal treatment or solution annealing remains indispensable to reduce the work hardening and redissolve precipitations. For the reasons already stated, this primarily applies to hot rolled strip and heavy plates having an end thickness of less than 60 mm, more particularly a thickness in the range between 8 and 40 mm. If therefore an increase in strength properties is not desired, it would be possible to reliably produce by the process disclosed in German OS No. 36 17 907 without subsequent solution annealing only heavy plates which have an end thickness of more than 60 mm, but which are only rarely used in practice. On the other hand, hitherto it has been possible to produce in a problem-free manner only hot rolled strip having an end thickness of less than about 5 mm, but in any case such strip must be solution-annealed following finish rolling.

However, in the manufacture of hot rolled strip and heavy plates from stainless heat resistant steels or from forgeable alloys on a nickel basis as shown in Table 1, it is becoming more and more necessary to have a single process for manufacturing such products over as wide a range as possible—i.e., including with a thickness in the range range of 5 to 60 mm, preferably 8 to 40 mm.

In this respect European patent No. 0 144 694 discloses a modified process for the production of flat, strip-shaped or plate-shaped semi-finished products, for example, having a final cross-section of 15 mm × 40 mm, from a stainless austenitic or martensitic steel, although a solution annealing is provided. In that process the workpiece of the stainless steel, having the composition stated in the citation, is first heated to a high temperature of the order of magnitude of 1200° C. and soaked at that temperature. Then at a temperature in the range of 1000° to 1100° C. it is bloomed and finish rolled in such a way as to ensure complete recrystallization of the workpiece by an adequate degree of deformation during the rolling process. After finish rolling to end thickness, a solution annealing is performed, followed by the quenching of the semi-finished product in water from said temperature range to substantially room temperature. It is an essential feature of the process that the solution annealing immediately following the rolling process is performed in heat following the or each final pass, the workpiece then being directly quenched in water from the solution annealing temperature without any further treatment.

Since as a rule the finish rolling temperature is too low for direct quenching, the workpiece produced by that process must first be heated by a heating system after finish rolling. Alternatively according to the process a rolling heating system is provided which substantially prevents premature and excessive cooling of the workpiece during rolling, to avoid any reheating of the finish-rolled workpiece to the necessary high solution annealing and quenching temperature of above 1000° C. However, even this additional heating system for the reheating of the finish-rolled product, and more particularly the proposed rolling heating would call for considerable extra cost in the hitherto conventional production of hot rolled strip or heavy plates.

It is an object of the invention to provide a process of the kind specified by which products in the form of hot rolled strip or heavy plates having the composition stated in Table 1 are hot rolled and after accelerated cooling have a spectrum of properties, for example, as regards strength, toughness and corrosion resistance, which corresponds to the spectrum of properties of solution-annealed hot rolled strip or heavy plate.

According to the invention this problem is solved as follows, in accordance with the steps set forth in the characterizing part of claim 1:

First of all the starting product, namely slabs from the monobloc casting or continuous casting of stainless and heat resistant steels, or of forgeable alloys on a nickel basis having the composition stated in Table 1 are produced and soaked at a temperature of more than 1100° C. prior to hot rolling. Then the hot rolling of the soaked slabs starts and continues without interruption first to a maximum 1/6 of their starting thickness—i.e., they are first reduced in the extreme case to a maximum 1/6 of their initial thickness, with as short pauses as possible between the individual deformation passes. The hot rolling is performed mainly with deformation passes in which the degree of deformation per pass in the thickness direction is greater than the degrees of deformation shown by the curve A in FIG. 1, in dependence on the surface temperature of the product. The degree of deformation phi is defined as $$\text{phi} = \ln h_{n-1}/h_n$$

where $h_n$ = workpiece thickness after the nth pass and $h_{n-1}$ = workpiece thickness after the (n−1)th pass.

If more than 50% of the selected deformation passes have a degree of deformation which is greater than the degrees of deformation indicated by curve A in FIG. 1, this means that, as in the process known from European patent No. 0 144 694, hot rolling is performed mainly in the recrystallization range, by which due to the high temperature very coarse-grained initial structures become substantially homogeneous, free from microscopic bursting and fine-grained in this first rolling phase.

As a rule the initial thickness of the slab or slabs is of the order of magnitude of about 150 to 250 mm. However, if the slabs produced by continuous casting have a thickness only of the order of magnitude of about 50 mm or lower, according to the invention the reduction of the product in this first rolling phase can be eliminated. However, conventionally a blooming phase is followed by finish rolling to the end thickness, such finish rolling being performed by step (ac) in claim 1 above a minimum temperature which depends on the molybdenum content of the product and which is the minimum temperature permissible.

In contrast with the current procedure described in the two aforementioned citations, in the finish rolling to end thickness according to the invention it is an essential feature thereof that rolling is performed not only in the recrystallization range—i.e., with deformation passes having degrees of deformation as shown in curve A in FIG. 1 and greater—, but the degrees of deformation of the predominant number of the selected deformation passes must be greater than the degrees of deformation shown by curves B1 or B2 in FIG. 1, in dependence on the surface temperature of the product and the pause between two successive deformation passes as parameters. Curve B1 applies to a pause between two successive passes of less than 10 seconds (hot rolled strip), and curve B2 to a pause between two successive passes of more than 10 seconds (heavy plate).

The first result of this use of these degrees of deformation according to the invention is that during finish rolling the structure is recrystallized homogeneously and fine-grained during finish rolling and the work hardening is reduced without the need for any subsequent thermal treatment for recrystallization prior to the accelerated cooling of the product, as provided in the process disclosed in European patent No. 0 144 694.

Moreover, this step substantially compensates heat losses occuring due to conduction and radiation.

When the hot rolled strip or heavy plate has been finish rolled to end thickness above the minimum temperature according to the invention as stated in step (ac) of claim 1, the accelerated cooling takes place at the latest in 100 seconds at a speed in the core of more than 3 K/sec, preferably more than 5 K/sec, to a temperature equal to or lower than 650° C.

By the process according to the invention hot rolled strip and heavy plates of the steels stated in Table 1 can be produced with an end thickness in the range of 5 to 60 mm and a spectrum of properties which corresponds to the mechanical properties and corrosion resistance of solution-annealed hot rolled strips and heavy plates. However, in contrast therewith the strips and plates produced according to the invention have a more uniform, more particularly very fine-grained and substantially precipitation-free structure, thus improving their machining and utility properties. More particularly the process according to the invention enables even thin strips and plates to be rolled to a preferred end thickness in the range of 8 to 40 mm using the deformation energy without any additional supply of energy during rolling out to end thickness in such a way as to obviate the necessity for subsequent solution annealing.

The properties of the strips and plates produced by the process according to the invention can be further improved and optimized by the hot rolling and subsequent accelerated cooling being performed by the steps stated in subclaims 2 to 7. The process according to claim 3 relates to the production of hot rolled strip, the process according to claim 4 relating to the production of heavy plates. If all the deformation passes of the blooming phase (claim 2) simultaneously have a degree of deformation which is greater than the degrees of deformation shown by curve A in FIG. 1, hot rolled strip and heavy plates can be produced with optimum values, for example, as regards strength, toughness and corrosion resistance.

Preferably the process according to the invention can be applied to the production of hot rolled strip and heavy plates from stainless and heat resistant steels having an analysis according to claims 8–11 and 14–17 and from forgeable alloys on a nickel basis having the composition stated in claims 12and 13. The result is hot rolled strip and heavy plates with a high degree of toughness and increased corrosion resistance, which subsequently as a finished product have good machinability as regards hot and cold shaping and welding.

If the steps according to the invention are applied to stainless austenitic steels having the composition stated in claims 17 which form delta ferrite during solidification, with correspondingly heavy demands on corrosion resistance, advantageously such steels are adjusted by alloying techniques to delta ferrite contents below 10%, preferably below 5%. This can be done according to the invention by reducing the contents of ferrite-forming elements, but preferably by raising the contents of austenite-forming alloying elements individually or in combination, with the exception of carbon. In accordance with Table 3 is:

$$DF\,[\%] = (2.9004 * Cr_{aq} - 2.084 * Ni_{aq}) - 25.62, \text{ with}$$

$$Cr_{aq} = Cr + Mo + 1.5 * Si + 0.5 * Nb + 4 * Ti + 3 * Al \text{ and}$$

$$Ni_{aq} = Ni + 0.5 * Mn + (C + N) + 0.5 * Cu.$$

EXAMPLES

Table 1 states the composition of those stainless and heat resistant steels and forgeable alloys on a nickel basis from which hot rolled strip and heavy plates can be produced by the process according to the invention. Of these steels the five different steel grades stated in Table 3 were selected, from which hot rolled strip having an end thickness of 10 and 15 mm and heavy plates having an end thickness in the range of 10 to 40 mm were produced by the process according to the invention. These were two stainless austenitic steels having a molybdenum content of less than 1.0%, two further stainless austenitic steels having a molybdenum content of more than 1.0%, and an alloy on a nickel basis having the composition stated in Table 3.

Of these five different steel grades, roughed slabs having a thickness in the range of 170 to 265 mm were produced and then heated at a temperature of more than 1100° C. and soaked at that temperature. Then the hot rolled strip and the heavy plates were rolled out hot from these soaked slabs by the process according to the invention, first in a blooming phase and then in a finish roll phase to end thickness, before the finish-rolled product was cooled at an accelerated rate at a speed of more than 3 K/sec to a temperature of less than 650° C. Both in the blooming phase and in the finish rolling phase the degrees of deformation per pass were selected in accordance with the dependence of the degree of deformation on the deformation temperature and the workpiece surface temperature according to the invention, as shown in Table 2 and illustrated in FIG. 1. Table 4 shows the individual hot rolling and cooling conditions by which the five different steels shown in Table 3 were rolled out to the end thickness as hot rolled strip (W) and heavy plates. The corresponding conditions of hot rolled strip and heavy plate not produced according to the invention are also stated. Table 5 compares with one another the results of hot rolled strip and heavy plate produced according to the invention, produced not according to the invention, and produced solution-annealed respectively.

If hot rolled strip and heavy plates having the composition stated in Table 3 are bloomed and finish rolled in accordance with claim 1 of the process according to the invention and then cooled at an accelerated rate at the latest 100 seconds after finish rolling, such strips and plates, as shown in Table 5, have a yield strength and tensile strength which are comparable with the corresponding values of solution-annealed strips and plates. As the corresponding column in Table 5 shows, the strips and plates produced according to the invention have an improved, more uniform, finer-grained and substantially precipation-free structure, something which has a positive effect on the processing and utilization properties of such strips and plates. Expansion and notch impact strength are comparable with the corresponding values of the products in the solution-annealed condition and lie in all cases in a narrow range of dispersion, but slightly above the minimum values.

As shown more particularly by the comparative examples not according to the invention and also set forth in Table 5, the process results in products of higher strength values, more particularly a higher yield point and lower expansion, with surface cracks and a coarser-grained mixed structure, unless the steps according to the invention (aa) (blooming phase), (ab) (finish rolling phase), (ac) (final rolling temperature) and (b) (accelerated cooling) are observed individually or in combination. The detail in this respect are as follows:

As shown more particularly by comparative examples 1.7 and 3.6, hot rolling in the blooming phase with the degrees of deformation of the deformation passes which are mainly lower than the degrees of deformation shown by curve A in FIG. 1 leads to harmful surface cracks in the product. Merely for this reason the strips and plates obtained are unusable. Neither in these cases can required values of yield point, tensile strength and expansion be adjusted. In this respect the product has mechanical properties which differ from the spectrum of properties of the product in the solution-annealed condition.

On the other hand, hot rolling in the recrystallization range at elevated temperatures, as already known from European Patent No. 0 144 694, is inadequate to adjust the properties required for hot rolled strip and heavy plates. As shown by comparative examples 1.8, 3.8 and 4.8 in Table 4 and the associated values of yield point, tensile strength, expansion and notch impact strength in Table 5 (in these cases the step (aa) according to the invention is met)—more particularly a substantially higher yield point and lower expansion are obtained, if the hot rolling condition according to the invention as set forth in feature (ab) of claim 1 is not met. The main point is therefore not only that the products are hot rolled in the recrystallization range—i.e., with degrees of deformation which are greater than the degrees of deformation shown by curve A in FIG. 1—, but more particularly in the finish rolling phase the steps (ab) and (ac) according to the invention as set forth in claim 1 must also be provided.

As can also be gathered from Tables 4 and 5, a homogeneous and fine-grained structure improved in comparison with the solution-annealed state can be set up if the hot rolling conditions are met in the finish rolling phase for hot rolled strip in accordance with subclaims 2 and 3 and for heavy plates in accordance with subclaims 2 and 4. If on the other hand the hot rolling conditions in the finish rolling phase meet in addition to step (ac) only feature (ab) as set forth in claim 1, as a rule a predominantly fine-grained structure is also obtained, but it also contains a small proportion of coarse grain. In these cases also the hot rolled strips and heavy plates produced according to the invention have values of mechanical properties and corrosion resistance which are comparable with the products in the solution-annealed condition.

As a whole, the exemplary embodiments of the invention and the comparative examples presented in Tables 4 and 5 show that the process according to the invention enables hot rolled strip and heavy plates of stainless and heat resistant steels or forgeable alloys on a nickel basis having the composition shown in Table 2 to be produced with an end thickness in the range of 5 to 60 mm, preferably in the range of 8 to 40 mm, with a spectrum of properties which corresponds to the spectrum of properties of the corresponding strips and plates in the solution-annealed condition. At the same time, the strips and plates according to the invention advantageously have a homogeneous and fine-grained as well as substantially precipitation-free structure, thus further improving their machining and utility properties. More particularly the process according to the invention makes it possible to produce more particularly hot rolled strip with an end thickness greater than about 5 mm in a very simple, inexpensive manner by a controlled hot rolling followed by accelerated cooling, without the need for subsequent solution annealing.

TABLE 1

| Alloying element | stainless and heat resistant steels: ferritic/martensitic | austenitic/ferritic | austenitic | Forgeable alloys on a nickel basis |
|---|---|---|---|---|
| | alloy content - in Mass % | | | |
| carbon | ≦0,35 | ≦0,05 | ≦0,15 | ≦0,1 |
| manganese | ≦2,5 | ≦10,0 | ≦20,0 | ≦4,0 |
| silicon | ≦1,5 | ≦1,5 | ≦4,0 | ≦4,0 |
| nickel | ≦3,0 | 4–7 | ≦35 | (Rest Ni) |
| chromium | 6–30,0 | 10–30,0 | 10–30,0 | 10–30 |
| molybdenum | ≦3,0 | ≦5,0 | ≦7,0 | ≦10 |
| titanium | ≦1,5 | ≦1,5 | ≦1,5 | ≦1,5 |
| tantalum/colunbium | ≦1,5 | ≦1,5 | ≦1,5 | ≦1,5 |
| copper | | ≦5,0 | ≦5,0 | ≦5,0 |
| aluminum | ≦1,5 | ≦0,5 | ≦1,0 | ≦0,5 |
| nitrogen | ≦0,5 | ≦0,5 | ≦0,5 | ≦0,5 |
| others | V ≦ 0,5<br>S ≦ 0,5<br>(Rest Fe) | (Rest Fe) | V ≦ 1,0<br>S ≦ 0,3<br>(Rest Fe) | Fe ≦ 45 |

TABLE 2

| Umformtemperatur $T_U$ (Walzgutoberflache) °C. | Kritischer Umformarad $\psi$*: Vorwalzphase Kurve A | Fertigwalzphase Kurve $B_1$ | Fertigwalzphase Kurve $B_2$ |
|---|---|---|---|
| 1200 | 0.046 | (0.061) | (0.083) |
| 1150 | 0.066 | 0.085 | 0.127 |
| 1100 | 0.094 | 0.116 | 0.178 |
| 1050 | 0.137 | 0.163 | 0.238 |
| 1030 | 0.163 | 0.191 | 0.269 |
| 1000 | 0.196 | 0.227 | 0.305 |
| 980 | 0.223 | 0.254 | 0.332 |

*Die Einzelwerte wurden auf 0.001 gerundet.
**for pauses less 10 s
***for pauses greater 10 s

TABLE 3

| Lfd.-Nr. | Werkstoff nach DIN | C | Si | Mn | P | S | Cr | Mo | Ni | N | Al | Ti | Delta-Ferrit DF (%) nach* |
|---|---|---|---|---|---|---|---|---|---|---|---|---|---|
| | | Chemische Zusammensetzung in Massen % | | | | | | | | | | | |
| 1 | 1.4301 | 0.035 | 0.34 | 1.45 | 0.023 | 0.003 | 18.0 | 0.20 | 8.7 | 0.057 | | | 3.3 |
| 2 | 1.4541 | 0.048 | 0.51 | 1.50 | 0.026 | 0.003 | 17.2 | 0.50 | 9.1 | | | 0.46 | 9.7 |
| 3 | 1.4404 | 0.027 | 0.29 | 1.58 | 0.026 | 0.008 | 16.7 | 2.16 | 11.1 | 0.044 | | | 1.1 |
| 4 | 1.4571 | 0.045 | 0.33 | 1.33 | 0.022 | 0.003 | 16.9 | 2.12 | 10.5 | | | 0.39 | 4.1 |
| 5 | 2.4858 | 0.013 | 0.32 | 0.79 | 0.015 | 0.003 | 20.7 | 2.85 | 39.25 | | 0.10 | 0.80 | — |

*DF (%) = (Craq 2.9004 − Niaq 2.084) − 25,62 mit
Craq = Cr + Mo + 1.5 Si + 0.5 Nb + 4 Ti + 3 Al
Niaq = Ni + 30 (C + N) + 0.5 Mn + 0.5 Cu

TABLE 4

| Stahl (DIN-Nr.) | Erzeugnis Nr. | Vorbrammen-dicke mm | End-dicke mm | Vorwalzphase Gesamt-stiche | Vorwalzphase davon mit $\psi > A_{(TU)}$ | Fertigwalzphase Gesamt-stiche | Fertigwalzphase davon mit $\psi > \eta_{(TU)}$ | Endwalz-temp. ($T_E$) °C. | Transfer-zeit $t_t$ s | Abkuhl-geschw. °C./s |
|---|---|---|---|---|---|---|---|---|---|---|
| 1.4301 | E 1.1 | 170 | 10 | 4 | 4 | 8 | 7 | 1065 | 25 | 30 |
| | 1.2 W | " | 15 | 5 | 4 | 7 | 6 | 1035 | <5 | 15 |
| | 1.3 | " | " | 4 | 4 | 6 | 6 | 1070 | 35 | >5 |
| | 1.4 | " | 40 | 4 | 4 | 4 | 3 | 1090 | 20 | 6 |
| | nE 1.5 | " | 10 | 4 | 3 | 8 | 5 | 1020 | | >5 |
| | 1.6 | " | 10 | 4 | 3 | 12 | 6 | 1040 | <5 | >5 |
| | 1.7 | " | 15 | 8 | 3 | 8 | 5 | 1035 | | >5 |
| | 1.8 | " | 20 | 4 | 3 | 10 | 5 | 1035 | | 8 |
| 1.4541 | E 2.1 W | 170 | 10 | 5 | 4 | 7 | 6 | 1065 | <5 | >5 |
| | 2.2 | 215 | " | 4 | 3 | 8 | 8 | 1110 | <10 | >5 |
| | 2.3 | 170 | 15 | 4 | 4 | 6 | 6 | 1075 | <10 | 20 |
| | 2.4 | " | " | 4 | 3 | 8 | 6 | 1065 | 25 | >6 |
| | 2.5 | " | 20 | 4 | 3 | 6 | 6 | 1080 | 80 | 7 |
| | nE 2.6 | 170 | 10 | 5 | 3 | 7 | 4 | 1000 | | >5 |
| | 2.7 | 215 | 10 | 6 | 4 | 12 | 6 | 1040 | | 1.0 |
| | 2.8 | 170 | 15 | 6 | 3 | 8 | 5 | 1035 | | >5 |
| | 2.9 | " | 20 | 4 | 3 | 10 | 5 | 1020 | | 25 |
| 1.4404 | E 3.1 W | 170 | 10 | 5 | 3 | 7 | 6 | 1075 | <5 | >5 |
| | 3.2 | " | 15 | 4 | 4 | 6 | 6 | 1105 | <10 | >5 |
| | 3.3 | " | 15 | 4 | 3 | 8 | 7 | 1090 | <10 | >5 |
| | 3.4 | " | 20 | 4 | 3 | 8 | 6 | 1080 | | >5 |
| | nE 3.5 | " | 10 | 4 | 4 | 8 | 5 | 1020 | >10 | <5 |
| | 3.6 | " | 10 | 6 | 2 | 10 | 6 | 1050 | | >5 |
| | 3.7 | " | 15 | 6 | 3 | 8 | 5 | 1030 | | >5 |
| | 3.8 | " | 15 | 4 | 3 | 10 | 5 | 1060 | | >5 |
| | 3.9 | " | 15 | 4 | 3 | 10 | 6 | 1060 | | 0.6 |
| 1.4571 | E 4.1 | 170 | 10 | 4 | 3 | 8 | 8 | 1100 | 20 | >5 |
| | 4.2 | 215 | 15 | 4 | 4 | 8 | 8 | 1125 | 30 | >5 |
| | 4.3 | " | " | 4 | 3 | 10 | 8 | 1090 | <10 | >5 |
| | 4.4 | 265 | 20 | 4 | 4 | 10 | 8 | 1085 | 50 | >5 |
| | 4.5 | " | 40 | 4 | 4 | 6 | 5 | 1050 | 20 | >5 |
| | nE 4.6 | 170 | 10 | 4 | 3 | 12 | 6 | 1000 | | >5 |
| | 4.7 | " | " | 4 | 2 | 8 | 6 | 1050 | | >5 |
| | 4.8 | 215 | 15 | 4 | 3 | 12 | 6 | 1060 | <10 | >5 |
| | 4.9 | 170 | 15 | 4 | 3 | 8 | 7 | 1060 | | 0.6 |
| 2.4858 | E 5.1 W | 180 | 15 | 5 | 3 | 7 | 6 | 1075 | <5 | >5 |
| | nE 5.2 W | " | " | 7 | 6 | 7 | 3 | 975 | | |

E - erfindungsgemab
nE - nicht erfindungsgemab
W - Warmband

TABLE 5

| Stahl (DIN-Nr.) | Erzeugnis Nr. | $R_{p0.2}$* N/mm² | $R_m$* N/mm² | $A_5$* % | $A_v$ (ISO-V)* RT (J) | $A_v$ (ISO-V)* −196° C. (J) | Korngrobe G n. DIN 50601 | Delta-Ferrit Gehalt*** | Korrosions-prufungen |
|---|---|---|---|---|---|---|---|---|---|
| 1.4301 | E 1.1 | 300 | 625 | 50 | 179 | | 8 – 9 | 3–6 | Anforderungen |
| | 1.2 W | 310 | 629 | 50 | 175 | | | | erfullt nach: |
| | 1.3 | 295 | 616 | 55 | 211 | | 8 | | 1; 2; 3 |
| | 1.4 | 281 | 596 | 62 | 201 | | 7 | | |
| | nE 1.5 | 408 | 672 | 36 | 111 | | | | |
| | 1.6 | 390 | 650 | 38 | 130 | | 8 + 4** | | |
| | 1.7 | 350 | 656 | 40 | 145 | | | | Oberflachenrisse |
| | 1.8 | 405 | 665 | 41 | 134 | | | | |
| | 1.L | 265– | 605– | 45– | 170– | 4 – 5 | 1–3 | | |
| | | 345 | 635 | 60 | 190 | | | | |
| 1.4541 | E 2.1 W | 298 | 595 | 50 | 170 | | | 2–4,5 | Anforderungen |
| | 2.2 | 280 | 590 | 55 | 185 | | | | erfullt nach: |
| | 2.3 | 255 | 587 | 55 | 184 | | 8 – 9 | | 1; 2; 3 |
| | 2.4 | 272 | 594 | 53 | 186 | | | | |
| | 2.5 | 259 | 575 | 58 | 164 | | 7 – 9 | | |
| | nE 2.6 | 450 | 679 | 35 | 98 | | | | |
| | 2.7 | 440 | 655 | 40 | 105 | | | | nicht erf. n. 2; 3 |
| | 2.8 | 385 | 627 | 43 | 128 | | 9 + 5** | | |
| | 2.9 | 395 | 641 | 41 | 129 | | | | |
| | 2.L | 245– | 580– | 40 | 150– | | 7 – 8 | 1,5–2 | |
| | | 345 | 640 | 53 | 195 | | | | |
| 1.4404 | E 3.1 W | 320 | 618 | 49 | 175 | | 9 | 1,5–4 | Anforderungen |
| | 3.2 | 281 | 590 | 54 | 189 | 125 | 8 | | erfullt nach: |
| | 3.3 | 344 | 601 | 52 | 195 | 154 | 8 – 9 | | 1; 2; 3; 4 |
| | 3.4 | 280 | 575 | 54 | 190 | 121 | 7 – 8 | | |
| | nE 3.5 | 479 | 692 | 33 | 102 | | | | |
| | 3.6 | 324 | 611 | 44 | 163 | | 9 + 5** | | Oberflachenrisse |
| | 3.7 | 435 | 670 | 38 | 125 | | | | |
| | 3.8 | 405 | 615 | 41 | 135 | | | | |
| | 3.9 | 340 | 610 | 42 | 145 | | | | |
| | 3.L | 250– | 570– | 46– | 175– | 50– | 4 + 5 | 0,5–2 | |

TABLE 5-continued

| Stahl (DIN-Nr.) | Erzeugnis Nr. | $R_{p0.2}$* N/mm² | $R_m$* | $A_5$* % | $A_v$ (ISO-V)* RT (J) | −196° C. (J) | Korngrobe G n. DIN 50601 | Delta-Ferrit Gehalt*** | Korrosions-prufungen |
|---|---|---|---|---|---|---|---|---|---|
| | | 310 | 605 | 55 | 230 | 65 | | | |
| 1.4571 | E 4.1 | 270 | 585 | 53 | 195 | | | 3–7 | Anforderungen |
| | 4.2 | 267 | 578 | 57 | 190 | | | | erfullt nach: |
| | 4.3 | 275 | 587 | 54 | 198 | | | | 1; 2; 3 |
| | 4.4 | 270 | 605 | 54 | 191 | | | | |
| | 4.5 | 300 | 625 | 50 | 178 | | | | |
| | nE 4.6 | 542 | 715 | 36 | 105 | | | | |
| | 4.7 | 430 | 625 | 38 | 115 | | | | |
| | 4.8 | 405 | 624 | 39 | 120 | | | | |
| | 4.9 | 425 | 674 | 32 | 96 | | | | nicht erf. n. 3; 4 |
| | 4.L | 275– | 560– | 43– | 145– | | | 2–5 | |
| | | 315 | 605 | 55 | 195 | | | | |
| 2.4858 | E 5.1 W | 290 | 605 | 50 | 205 | | | | Anf. erf. n.: 1; 2; 3 |
| | nE 5.2 W | 545 | 716 | 28 | 96 | | | | |
| | 5.L | 265– | 600– | 45 | 190– | | | | |
| | | 295 | 625 | 50 | 215 | | | | |

E - erfindungsgemab
nE - nicht erfindungsgemab
L - Losungsgegluht
W - Warmband
*quer zur Walzrichtung
**Mischkorngefuge
***gemessen mit der Forster-Sonde
Korrosionstests:
1 - Straub-Test n. DIN 50914
2 - mod. Streicher-Test n. SEP 1877
3 - Streicher-Test n. ASTM 262 Pract. B
4 - Buey-Test n. DIN 50921

KEY TO WORDING OF TABLES AND FIGURE

Table 2

A=deforming temperature $T_U$ (workpiece surface) in ° C.;
B=critical degree of deformation $\phi$*;
C=cogging phase;
D=finish rolling phase;
E=curve A, etc.;
F=(footnote) * - Individual values rounded off to 0.001.

Table 3

A=serial number;
B=material to DIN;
C=chemical composition in % by mass;
D=delta ferrite DF (%) to *;
E=Cr equivalent;
F=with;
G=Ni equivalent.

Table 4

A=steel (DIN No.);
B=product no.;
C=roughed slab thickness in mm;
D=final thickness in mm;
E=cogging phase;
F=total passes;
G=of which with $\phi > A_{(TU)}$;
H=finish rolling phase;
I=end rolling temperature ($T_E$) in ° C.;
J=transfer time $t_t$ in seconds;
K=cooling speed in ° C./seconds.
Footnotes: E=according to the invention;
nE=not according to the invention;
W=hot rolled strip.

Table 5

A=steel (DIN No.);
B=product no.;
C=grain size G to DIN 50601;
D=delta ferrite content ***);
E=corrosion tests;
F=demands met to 1: 2: 3;
G=surface cracks;
H=not met to 2:3;
I=surface cracks.
Footnotes (left-hand side):
E=according to the invention;
nE=not according to the invention;
L=solution-annealed;
W=hot rolled strip;
*=transversely of the rolling direction;
**=mixed grain structure;
***=measured with the Förster probe.
Footnotes (right-hand side): corrosion tests:
1=Strauβ test to DIN 50914;
2=modified Streicher test to SEP 1877;
E=Streicher test to ASTM 262 Pract. B;
4=Huey test to DIN 50921.

FIG. 1

Ordinate=deformation temperature $T_U$ (workpiece surface) in ° C.;
abscissa=degree of deformation $\phi$.

We claim:

1. In the production of hot rolled strip or heavy plates from stainless and heat resistant steels or from forgeable nickel-based alloys with a final thickness in the range of 5 to 60 mm by the production of a slab from monobloc casting or by continuous casting and heating of the slab at a temperature above 1100° C., followed by the hot rolling of the slab and accelerated cooling of the product rolled to the end thickness, the improvement which comprises (a) first rolling the heated slab (aa) to a maximum of 1/6 of its initial thickness by deformation passes in which the degree of deformation per pass in the thickness direction is greater that the degrees of deformation shown by curve A in FIG. 1, in dependence on the surface temperature of the product, (ab) then without interruptions finish rolling the heated slab to the end thickness by deformation passes in which the degree of deformation per pass in the thickness direction is greater than the degrees of deformation shown by curve B1 or curve B2 in FIG. 1, in dependence on the surface temperature of the product and the pause between two adjacent passes as parameters, while the surface temperature of the finished rolled product
is not less than 1030° C., if the product contains up to 1.0% molybdenum and
is not less than 1050° C., if the product contains more than 1.0% molybdenum and (b) at the latest 100 seconds following finish rolling, cooling the product at an accelerated rate with a speed in the core of more than 3 K/sec, to a temperature which is equal to or lower than 650° C.

2. A process according to claim 1, wherein all the deformation passes by which the heated slab is first rolled to a maximum of 1/6 of its initial thickness are performed with a degree of deformation which is greater than the degrees of deformation shown by curve A in FIG. 1, in dependence on the surface temperature of the product.

3. A process according to claim 1, wherein at least $\frac{2}{3}$ of the deformation passes by which the product is rolled to the end thickness is performed with a degree of deformation which is greater than the degrees of deformation shown by curve B1 in FIG. 1, in dependence on the surface temperature of the product and the pause between two adjacent passes as parameters.

4. A process according to claim 1, wherein at least $\frac{3}{4}$ of the deformation passes by which the product is rolled to the end thickness is performed with a degree of deformation which is greater than the degrees of deformation shown by curve B2 in FIG. 1, in dependence on the surface temperature of the product and the pause between two adjacent passes as parameters.

5. A process according to claim 1, wherein the finish rolled product is slowly cooled in air to room temperature following the accelerated cooling.

6. A process according to claim 1, wherein the finished rolled product is a stainless and heat resistant ferritic, martensitic or austenitic-ferritic steel, and is cooled with acceleration to a temperature which is equal to or lower than 400° C.

7. A process according to claim 1, wherein the slab is produced from a stainless and heat resistant ferritic or martensitic steel, consisting of max. 0.35% C., max. 2.5% Mn, max. 1.5% Si, max. 3.0% Ni, 6.0 to 30.0% Cr, max. 3.0% Mo, balance iron and unavoidable impurities.

8. A process according to claim 7, wherein max. 1.5% Ti, max. 1.5% Ta and/or Nb, max. 1.5% Al, max. 0.5% N, max. 0.5% V and max. 0.5% S are additionally alloyed individually or in combination with the stainless and heat resistant ferritic or martensitic steel.

9. A process according to claim 1, wherein the slab is produced from a stainless and heat resistant austenitic-ferritic steel, consisting of max. 0.05% C, max. 10.0% Mn, max. 1.5% Si, 4.0 to 7% Ni, 10.0 to 30.0% Cr, max. 5.0% Mo. balance iron and unavoidable impurities.

10. A process according to claim 9, wherein max. 1.5% Ti, max. 1.5% Ta and/or Nb, max. 5.0% Cu, max. 0.5% Al and max. 0.5% N are additionally alloyed individually or in combination with the stainless and heat resistant austenitic-ferritic steel.

11. A process according to claim 1, wherein the slab is produced from a forgeable alloy on a nickel basis, consisting of max. 0.1% C, max. 4.0% Mn, max. 4.0% Si, 10.0% to 30.0% Cr, max. 10.0% Mo, and unavoidable impurities.

12. A process according to claim 11, wherein the max. 1.5% Ti, max. 1.5% Ta and/or Nb, max. 5.0% Cu, max. 0.5% Al, max. 0.5% N and max 45.0% Fe are alloyed individually or in combination with the forgeable Ni-based alloy.

13. A process according to claim 1, wherein the slab is produced from a stainless, heat resistant austenitic steel consisting of max. 0.15% C, max. 20.0% Mn, max. 4.0% Si, max. 35.0% Ni, 10.0 to 30.0% Cr and max. 7.0% Mo residue iron and unavoidable impurities.

14. A process according to claim 13, wherein max. 1.5% Ti, max. 1.5% Ta and/or Nb, max. 5.0% Cu, max. 1.0% Al, max. 0.5% N, max. 1.0% V and max. 0.3% S are additionally alloyed individually or in combination with the stainless, heat resistant austenitic steel.

15. A process according to claim 1, wherein the slab is produced from a stainless, heat resistant austenitic steel having max. 3.0% Si, 7.0 to 35.0% Ni, max. 0.5% Al and max. 0.035% S.

16. A process according to claim 15, wherein stainless, heat resistant austenitic steel is alloyed with 7.0 to 20.0% Ni, 15.0 to 25.0% Cr and max. 5.0% Mo.

17. A process according to claim 16, wherein the delta ferrite content in the stainless and heat resistant austenitic steel used is adjusted to a value lower than 10%, by controlling the quantities of the alloying elements Ni, N, Mn and/or Cu added to the steel.

18. A process according to claim 1, wherein the finish rolled product is a stainless and heat resistant ferritic or martensitic steel containing up to 1.0% molybdenum and its surface temperature is not less than 980° C. before the accelerated cooling.

19. A process according to claim 1, wherein the finish rolled product is a stainless and heat resistant ferritic or martensitic steel containing more than 1.0% molybdenum and its surface temperature is not less than 1000° C. before the accelerated cooling.

* * * * *

UNITED STATES PATENT AND TRADEMARK OFFICE

CERTIFICATE OF CORRECTION

PATENT NO. : 4,994,118

DATED : February 19, 1991

INVENTOR(S) : Pircher et al.

It is certified that error appears in the above-identified patent and that said Letters Patent is hereby corrected as shown below:

Col. 14, line 28 Delete " residue " and substitute -- balance --

Col.14, line 38 After " wherein " insert -- the --

Signed and Sealed this

Twentieth Day of April, 1993

*Attest:*

MICHAEL K. KIRK

*Attesting Officer*

*Acting Commissioner of Patents and Trademarks*